US005222644A

United States Patent [19]

Moreno

[11] Patent Number: 5,222,644

[45] Date of Patent: Jun. 29, 1993

[54] WRAP DISPENSER WITH SAFETY CUTTER EDGE

[76] Inventor: Ruth B. Moreno, 5505 Akridge Ct., Fairfax, Va. 22032

[21] Appl. No.: 894,956

[22] Filed: Jun. 8, 1992

[51] Int. Cl.[5] ..... B26F 3/02

[52] U.S. Cl. ..... 225/19; 225/43; 225/89

[58] Field of Search ..... 225/19, 20, 43, 89

[56] References Cited

U.S. PATENT DOCUMENTS 690,165 12/1901 Leonhard ..... 225/89 X
2,806,529 9/1957 Bulman ..... 225/89 X
3,552,614 1/1971 Wilson et al. ..... 225/20
3,972,458 8/1976 Hamada ..... 225/20
4,130,228 12/1978 Perrin ..... 225/19

*Primary Examiner*—Frank T. Yost
*Assistant Examiner*—Raymond D. Woods
*Attorney, Agent, or Firm*—Richard C. Litman

[57] ABSTRACT

A dispenser for rolls of sheet material where the enclosure has a hinged section attached to the serrated cutting blade enabling the blade to pivot about a longitudinal axis past a lipped rubber gasket extending along the front edge of the bottom wall of the enclosure, preventing children or others from cutting themselves when the device is not in use.

2 Claims, 2 Drawing Sheets

WRAP DISPENSER WITH SAFETY CUTTER EDGE

BACKGROUND OF THE INVENTION

1. Field of the Invention

The present invention relates to a wall mounted roll dispenser for cellophane wrapping material and particularly one that has the serrated cutting blade or edge attached to a hinged plate, allowing the blade to be pivoted into position behind a flexible rubber gasket, thereby preventing users, particularly children, from accidentally cutting themselves.

2. Description of the Prior Art

Wall mounted dispensers for rolled materials that are non-perforated are provided with sharp serrated cutting edges, especially for cellophane cling wrap which requires a sharp edge for cutting; otherwise the material will only stretch and deform instead of separating. These sharp edges can constitute a hazard to children or unwitting people, especially when the dispenser is mounted over a counter space in a home or commercial kitchen where even brushing the cutting surface can result in a deep gash.

Wrap dispensers are well known in the prior art, some of them wall mounted and some in boxes, this being the most common way that the wrap is sold.

U.S. Pat. No. 3,173,590 issued on Mar. 16, 1965 to Erwin B. Bahnsen discloses a wall mounted dispenser for rolled material with two cutting edges, one on a bottom wall and another on an apron that overlies, at least in part, the same bottom wall and forms a throat through which the material can be grasped and fed. Severing the material can be accomplished by the user by either pulling up or down on the material.

U.S. Pat. No. 3,722,767 issued on Mar. 27, 1973 to Glenn E. Struble discloses a box for dispensing rolled material wherein the front wall panel of the box has two portions which are pivotable and where the serrated edge of the dispenser can be located beneath a covering flap when the box is closed.

Neither of the above patents, taken either singly or in combination, are seen to address the safety problem inherent in the sharp cutting blade or describe the instant invention as claimed.

SUMMARY OF THE INVENTION

The present invention is an improved dispenser for rolled material including a cutting edge stowed behind a flexible rubber, protective, safety gasket when not being used. The dispenser has a single cover, hinged at the top rear wall, to allow loading of the rolled material, this cover also being hinged at the bottom front portion to allow the positioning of the cutting blade either aligned with the front cover edge for dispensing or at approximately a 90 degree angle to the front cover edge, passing inside the flexible rubber safety means that extends the length of the forward edge of the bottom wall of the enclosure.

Accordingly, it is a principal object of the invention to have a dispenser for rolled material that can be mounted on a wall above a counter, the cutting blade of the dispenser being pivoted, passing inside a flexible, lipped safety guard when not in use, thus protecting users from cutting themselves.

It is another object of the invention to provide a rolled material dispenser having a pivoted cutting edge normally retained behind a safety guard when not in use, and manually pivoted to an exposed position for severing a length of the rolled material.

It is a further object of the invention to provide a rolled material dispenser with a pivoted cutting edge retained behind a safety guard when not in use, the dispenser including side walls with cut outs for finger access to the cutter so that the cutter blade may be pivoted outwardly for use, and returned to a concealed, safety location behind the safety guard after use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
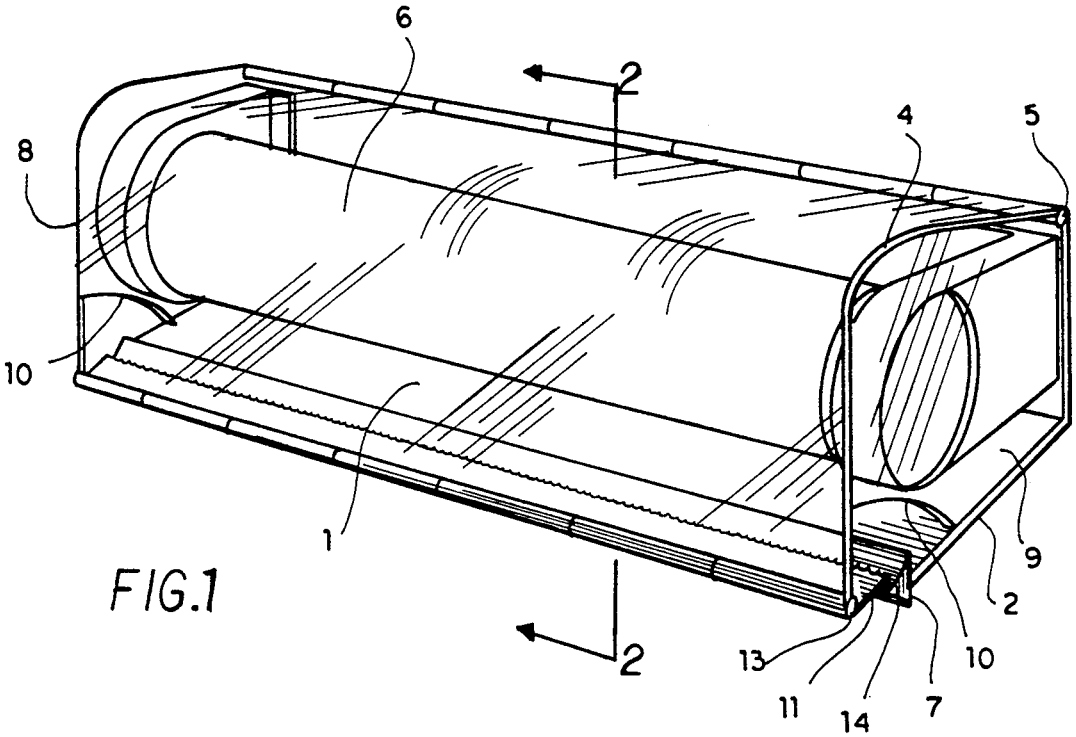
FIG. 1 is a perspective view of the present invention in a closed position with the cutting blade in a safe, stowed configuration.
Figure 3:
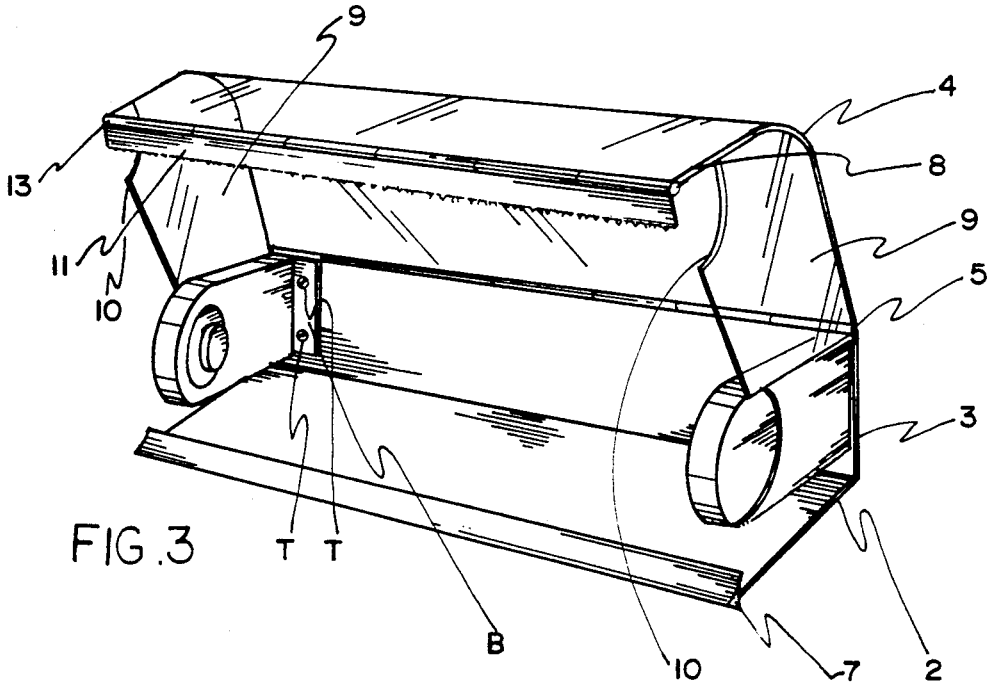
FIG. 3 is a perspective view of the present invention in an open position, ready for insertion of a roll of wrap material.

Referring to FIG. 1, the dispenser of this invention is made up of an enclosure 1 with a bottom wall 2, a rear wall 3, and a cover 4. The cover 4 has a rear edge which is fixed to the rear wall 3 by a hinge 5 that allows for the installation of the rolled material 6. This open configuration, without the rolled material installed, and with wall mounting bracket B and mounting screws T, is shown in FIG. 3.

Figure 4:
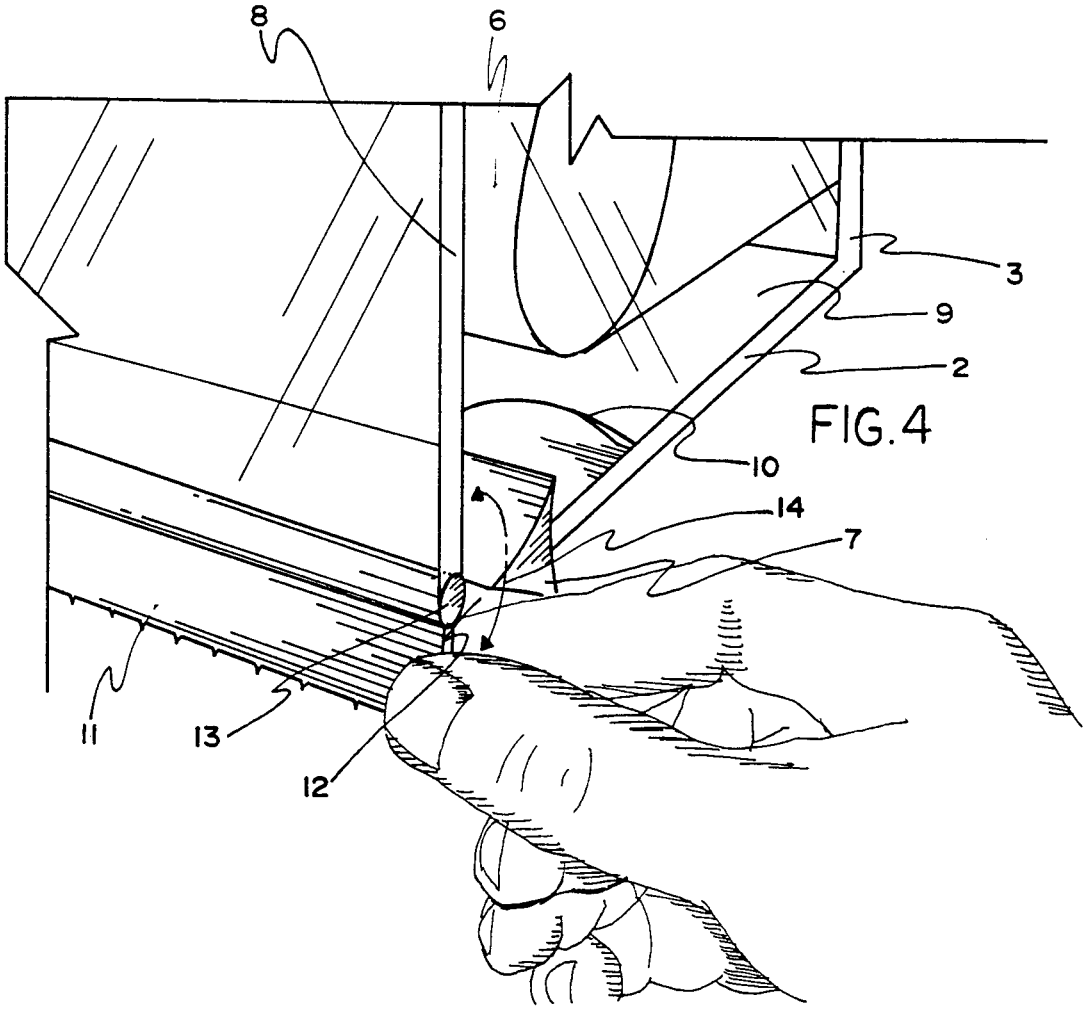
FIG. 4 is an enlarged fragmentary view illustrating the hinged motion of the cutting blade to and from a stowed position.

The bottom wall 2 has a free forward edge to which is attached an elongate, flexible, protective safety guard 7 with a lip 14 to retain a cutting blade or serrated edge cutter 11. The cover structure includes a front edge 8 and two side walls 9 with cut outs 10. When the cover is closed, and as best seen in FIG. 4, cut outs 10 are located adjacent to the cover front edge 8 and bottom wall 2 of the enclosure 1 to enable finger manipulation of the cutter 11 to an operative position, outside of and below the guard 7. Of course, rolled material 6 is fed through the material dispensing throat 12 located between the safety guard 7 and cutter 11 as shown in FIG. 4.

Figure 2:
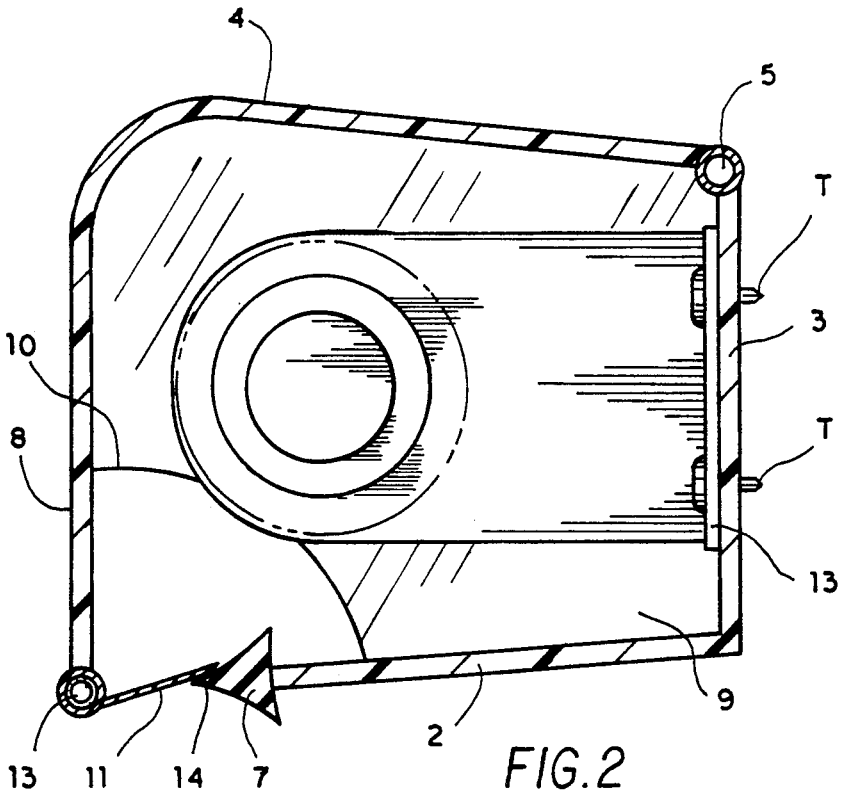
FIG. 2 is a sectional view drawn along line 2—2 of FIG. 1.

The cutter 11 is attached by a hinge 13 to the cover front edge 8 and is pivoted about the longitudinal axis of hinge 13 to rest in either a safety position, as shown in FIGS. 1 and 2, or a cutting position as shown in FIG. 4, for the severing of the rolled material 6 as it passes through the material dispensing throat 12. It should be noted that the cross sectional triangular shape of the protective safety guard as shown in FIG. 2 is not the sole form possible for the proper functioning of this embodiment of the instant invention, nor is the shape of the enclosure limited to that shown.

It is to be understood that the present invention is not limited to the sole embodiment described above, but encompasses any and all embodiments within the scope of the following claims.

I claim:

1. A safety dispenser for a roll of sheet material comprising: an enclosure including a rear wall, a bottom wall having a free forward edge, and a cover having a rear edge hingedly mounted to said rear wall and being movable to an open position for insertion of the roll of sheet material and being movable to a closed position for dispensing the sheet material; said cover having a front edge containing a cutting edge and a hinge for mounting said cutting edge to the cover front edge and enabling rotation of said cutting edge; said free forward edge of the bottom wall containing an elongate flexible gasket with a lip extending therefrom to retain and safely store said cutting edge when said cover is in the closed position and said cutting edge is not in use; and said enclosure forming a material dispensing throat located between the bottom wall forward edge and the cover front edge when said cover is in the closed position and said cutting edge is in use.

2. The invention as claimed in claim 1, wherein said cover has two side walls, said side walls having means defining cut out sections adjacent to said cover front edge and said bottom wall to enable manipulation of the sheet material and said cutting edge.

* * * * *